US009561931B2

(12) United States Patent
Kauppinen et al.

(10) Patent No.: US 9,561,931 B2
(45) Date of Patent: Feb. 7, 2017

(54) TOUCH SCREEN CALL-GIVING DEVICE AND METHOD FOR GIVING ELEVATOR CALL

(71) Applicants: Tuukka Kauppinen, Suzhou (CN); Johannes De Jong, Jarvenpaa (FI); Harri Länsiö, Hyvinkaa (FI); Santeri Suoranta, Espoo (FI)

(72) Inventors: Tuukka Kauppinen, Suzhou (CN); Johannes De Jong, Jarvenpaa (FI); Harri Länsiö, Hyvinkaa (FI); Santeri Suoranta, Espoo (FI)

(73) Assignee: KONE CORPORATION, Helsinki (FI)

( * ) Notice: Subject to any disclaimer, the term of this patent is extended or adjusted under 35 U.S.C. 154(b) by 507 days.

(21) Appl. No.: 14/030,310

(22) Filed: Sep. 18, 2013

(65) Prior Publication Data

US 2014/0014444 A1 Jan. 16, 2014

Related U.S. Application Data

(63) Continuation of application No. PCT/FI2012/050384, filed on Apr. 18, 2012.

(30) Foreign Application Priority Data

Apr. 21, 2011 (FI) ..... 20115395

(51) Int. Cl.
*B66B 1/34* (2006.01)
*B66B 1/36* (2006.01)
*B66B 1/46* (2006.01)

(52) U.S. Cl.
CPC ..... *B66B 1/36* (2013.01); *B66B 1/468* (2013.01); *B66B 2201/463* (2013.01); *B66B 2201/4623* (2013.01)

(58) Field of Classification Search
CPC .... B66B 1/36; B66B 1/468; B66B 2201/4623; B66B 2201/463
(Continued)

(56) References Cited

U.S. PATENT DOCUMENTS 5,594,469 A * 1/1997 Freeman ..... G05B 19/106 345/157
6,902,041 B2 * 6/2005 Eccleston ..... B66B 1/463 187/380
(Continued)

FOREIGN PATENT DOCUMENTS

CN 101992979 A 3/2011
EP 2159183 A1 3/2010
(Continued)

OTHER PUBLICATIONS

Chinese Office Action issued in corresponding Chinese patent application No. 201280019469.9, dated Oct. 23, 2014.
(Continued)

*Primary Examiner* — Anthony Salata
(74) *Attorney, Agent, or Firm* — Harness, Dickey & Pierce

(57) ABSTRACT

A call-giving device for giving an elevator call for an elevator includes a touch-sensitive display having at least one touch detection area. The call-giving device is configured to: detect a first gesture performed in the at least one touch detection area; register a call to a floor according to a floor marking in response to detecting a touch meeting call-giving criterion on the touch-sensitive display at a point corresponding to the floor marking; and present, on the touch-sensitive display, registration data associated with the registered call, the registration data indicative of registered floor calls that have not yet been served by the elevator.

26 Claims, 4 Drawing Sheets

(58) Field of Classification Search
USPC ..... 187/247, 380–388, 391, 393, 395, 396
See application file for complete search history.

(56) References Cited

U.S. PATENT DOCUMENTS

| | | | | |
|---|---|---|---|---|
| 7,877,707 | B2 * | 1/2011 | Westerman | G06F 3/04883 715/863 |
| 8,457,353 | B2 * | 6/2013 | Reville | G06F 3/017 382/103 |
| 8,705,872 | B2 * | 4/2014 | Ivanich | H04N 5/4403 345/156 |
| 8,763,762 | B2 * | 7/2014 | Finschi | B66B 1/468 187/391 |
| 9,045,314 | B2 * | 6/2015 | Finschi | B66B 1/467 |
| 9,079,749 | B2 * | 7/2015 | Hsieh | B66B 3/002 |
| 9,134,799 | B2 * | 9/2015 | Mark | G06F 1/1639 |
| 2007/0268265 | A1 | 11/2007 | XiaoPing | |
| 2009/0294221 | A1 | 12/2009 | Bahjat et al. | |
| 2010/0175953 | A1 | 7/2010 | Kostka | |
| 2012/0175192 | A1 * | 7/2012 | Tsou | B66B 1/468 187/247 |
| 2013/0246955 | A1 * | 9/2013 | Schwesig | G06F 3/017 715/767 |
| 2014/0173529 | A1 * | 6/2014 | Hicks | G06F 3/04883 715/863 |
| 2014/0380249 | A1 * | 12/2014 | Fleizach | G06F 3/017 715/863 |

FOREIGN PATENT DOCUMENTS

| | | | |
|---|---|---|---|
| FI | 112070B | B1 | 8/2002 |
| JP | 5-1770 | U | 1/1993 |
| JP | 6144726 | A | 5/1994 |
| JP | 2004-277119 | A | 10/2004 |
| JP | 2005-200145 | A | 7/2005 |
| JP | 2011037570 | A | 2/2011 |
| KR | 20100109736 | A | 10/2010 |
| WO | WO-2006/011876 | A1 | 2/2006 |
| WO | WO-2007/046807 | A1 | 4/2007 |
| WO | WO-2010/092230 | A1 | 8/2010 |

OTHER PUBLICATIONS

Extended European Search Report dated Feb. 26, 2015, issued in Application No. 12774152.8.
Written Opinion PCT/ISA/237 for PCT/FI2012/050384 dated Aug. 7, 2012.
International Search Report PCT/ISA/210 for PCT/FI2012/050384 dated Aug. 7, 2012.
Finnish Search Report for FI 20115395 dated Sep. 2, 2011.

* cited by examiner

TOUCH SCREEN CALL-GIVING DEVICE AND METHOD FOR GIVING ELEVATOR CALL

This application is a continuation of PCT International Application No. PCT/FI2012/050384, which has an International filing date of Apr. 18, 2012, and which claims priority to Finnish patent application number 20115395 filed Apr. 21, 2011, the entire contents both of which are incorporated herein by reference.

FIELD OF THE INVENTION

The present invention relates to call-giving in an elevator system.

BACKGROUND OF THE INVENTION

In an elevator system the travel of the elevators is controlled on the basis of elevator calls. The giving of calls is conventionally arranged by disposing up/down buttons on each floor of the building, by means of which an arriving elevator customer expresses his/her desired direction of travel. Additionally, a control panel customized to the disposal location of the elevator system is needed in the elevator car, on which control panel the elevator passenger presses the pushbutton according to his/her desired destination floor. With a conventional call-giving method an elevator customer must therefore give two calls. First the elevator must be called to the floor on which the customer is located with one press of a call pushbutton. In addition to this, a second press of a call pushbutton is needed in the elevator car.

Since buildings are individual in terms of the number of floors they have and of their floor markings or floor designations, an individually fabricated car control panel according to each building is needed in each elevator car of the building. Owing to the abundance of different options and, on the other hand, the physical presence of the panel, i.e. the multitude of pushbuttons and wirings, this type of control panel for calls is an expensive component.

The call method in which an elevator passenger selects his/her destination floor already in the elevator lobby outside the elevator is called destination allocation. In this way the aforementioned problem of high costs becomes emphasized, because each floor of a building in this case needs its "own car panel", which contains call pushbuttons corresponding to all the floors of the building that need to be served. The quantity of call panels per delivery in high-rise buildings is large and the costs can increase to become very large.

One option for call panels to be disposed on a floor is a keypad, which is of the telephone keypad type with number buttons from zero to nine. The downside of this solution is that in this case the building cannot contain floors designated with letter markings, of the type that can be e.g. B (basement); the use of this type of keypad is also rather laborious.

One option is to use two buttons for giving the desired call, with one of which the call number list can be scrolled forwards one floor number at a time and with the other correspondingly backwards. In addition, this type of call-giving system needs an accept button, with which the desired call data can be sent to the control system. This type of method is, however, impractical in high-rise buildings. If, for example, an elevator customer while on the ground floor wants to go to floor 30, he/she must press the button scrolling forwards 30 times and after this the accept button.

AIM OF THE INVENTION

The aim of the present invention is to solve the aforementioned problems as well as the problems disclosed in the description of the invention below. To achieve this aim the invention discloses call-giving device, elevator systems, and methods Some inventive embodiments and inventive combinations of the various embodiments are also presented in the descriptive section and in the drawings of the present application.

SUMMARY OF THE INVENTION

The call-giving device according to the invention for giving an elevator call comprises at least one area detecting a touch, and the call-giving device is configured to detect a gesture to be performed in an area detecting a touch. By means of this type of call-giving device that detects a gesture, call information can be given also in the form of a gesture instead of just a press, which enables an increase in the amount of call information without the call-giving procedure becoming unnecessarily complex.

In a preferred embodiment of the invention the call-giving device comprises a display for presenting a floor marking.

In a preferred embodiment of the invention the call-giving device is configured to move a floor marking to be presented on the display on the basis of a gesture to be performed in an area detecting a touch.

In the invention the term floor marking refers to a type of marking that contains information about a destination floor, in other words about the floor that is the destination of an elevator passenger.

In a preferred embodiment of the invention the call-giving device is configured to detect the movement direction of a gesture to be performed in an area detecting a touch, and the call-giving device is configured to move a floor marking to be presented on the display in the detected movement direction. By means of a call-giving device detecting the movement direction, the amount of information to be given in connection with a call can be further increased while at the same time retaining the ease of giving a call. In addition, by moving the floor marking to be presented on the display the surface area of the display can be utilized very efficiently.

In a preferred embodiment of the invention the call-giving device is configured to determine the movement speed of a gesture to be performed in an area detecting a touch, and the call-giving device is configured to move a floor marking at a speed that is proportional to the determined movement speed of the gesture to be performed in an area detecting a touch. In this way the area of the display of a call-giving device can be utilized very efficiently, which enables the processing of a larger amount of information, and on the other hand also the size of the display, and at the same time of the call-giving device, can be reduced. Furthermore, the amount of call information to be given in connection with a call can be increased utilizing the speed of the gesture, without the call-giving procedure becoming essentially complex.

In a preferred embodiment of the invention the call-giving device is configured to detect a gesture to be performed in an area detecting a touch for decelerating the speed of a floor marking that has been brought to move, and the call-giving device is configured to decelerate the speed of the floor marking that has been brought to move, on the basis of the gesture to be performed for decelerating the aforementioned floor marking. Consequently, the person giving a call is able to control the scrolling of floor markings and the selection of a floor marking better, and the giving of a call becomes easier and more accurate.

The invention also relates to a call-giving device, which comprises means for receiving an input given by a user. The call-giving device comprises a display for presenting a floor marking, and the call-giving device is configured to move a floor marking to be presented on the display on the basis of an input given by a user. By changing the position of a floor marking on the display in the manner presented in the invention the surface area of the display can be utilized efficiently.

In a preferred embodiment of the invention the call-giving device is configured to decelerate at a set deceleration the speed of a floor marking that has been brought to move. In this way the call-giving procedure is more controlled, the usability of the call-giving device improves and giving a call becomes more precise. In this way also the stopping of the floor markings to be presented on the display/stabilization of the display after a certain time delay is ensured.

In a preferred embodiment of the invention the call-giving device comprises a touch-sensitive display. The touch-sensitive display comprises in this case an area detecting a touch combined with the display, which reduces the size of the call-giving device and on the other hand improves usability.

In a preferred embodiment of the invention the call-giving device is configured to register a call to a floor according to a floor marking when detecting a touch meeting the call-giving criterion on the display at the point of the aforementioned floor marking. Consequently, the call to be given can be explicitly connected to the desired floor marking. In a preferred embodiment of the invention the call-giving device is configured to present on the display separate registration data connected to a registered call. Consequently, the valid registered calls connected to a call-giving device or to an elevator in the immediate proximity of a call-giving device can be presented on the display, and the call-giving situation can be controlled with one inspection of the display. In some embodiments a registered call can also be cancelled by performing a gesture on the display for cancelling the registered call. The gesture can be performed e.g. starting from the registration data of the call presented on the display and ending in an edge area of the display. In this way a registered call can be removed with one gesture to be performed on a touch-sensitive display, by dragging the registration data to outside the display.

In a preferred embodiment of the invention the call-giving device is configured to present on the display simultaneously a number of floor markings situated consecutively to each other, which increases the information to be presented relating to the giving of a call. The sequence of the floor markings in a string formed by floor markings consecutive to each other is preferably from the floor marking indicating the lowest floor to the floor marking indicating the highest floor, and vice versa, depending on the direction from which the string is viewed.

In a preferred embodiment of the invention the call-giving device is configured to detect a gesture to be performed in the direction of a string formed by floor markings consecutively situated on the display as well as the movement direction of a gesture to be performed in the direction of the string, and the call-giving device is configured to move the aforementioned string formed by the floor markings in the detected movement direction in the direction of the string. In this way a number of floor markings can be managed with one call-giving procedure on the display, which simplifies e.g. the giving of a destination call.

In a preferred embodiment of the invention the call-giving device comprises a memory, in which are recorded the consecutively situated floor markings intended to be presented on the display and also the consecutive sequence among the floor markings, and the call-giving device is configured to present on the display only a part at a time of the aforementioned consecutively situated floor markings to be recorded in the memory. Consequently, when the amount of floor markings to be presented on the display decreases, the size of the floor markings to be presented can be increased and/or the surface area of the display, and thus the size of the call-giving device, can be reduced. In addition, floor markings can be removed from the display/can be added to the display in the correct sequence utilizing the data recorded in memory about the consecutive sequence of the floor markings.

In a preferred embodiment of the invention a string formed by floor markings consecutively situated on the display travels on the display starting from an edge area of the display and ending in an edge area of the display. Consequently, the surface area of the display can be used to advantage efficiently and in full, which is an advantage particularly when using a small-sized display.

In a preferred embodiment of the invention the call-giving device is configured to remove a floor marking from the display when it arrives in an edge area of the display. When a floor marking is removed when it arrives in an edge area, only some of all the possible floor markings can be presented on the display at one time and on the other hand the removal of floor markings in this case occurs in a controlled and predictable manner, which improves the usability of the call-giving device.

In a preferred embodiment of the invention the call-giving device is configured to add a second floor marking, in place of a floor marking to be removed from the display, to the opposite end of a string formed by the floor markings. When a floor marking is added in place of a floor marking to be removed from the display, and to the opposite end of a string formed by the floor markings than the floor marking to be removed, only some of all the possible floor markings can be presented on the display at one time and on the other hand the addition of floor markings in this case occurs in a controlled and predictable manner.

In the method according to the invention for giving an elevator call a gesture to be performed in an area detecting a touch of the call-giving device is detected.

In a preferred embodiment of the invention a floor marking to be presented on the display of the call-giving device is moved on the basis of a gesture to be performed in an area detecting a touch.

In a preferred embodiment of the invention the movement direction of a gesture to be performed in an area detecting a touch is detected, and a floor marking to be presented on the display of the call-giving device is moved in the detected movement direction.

In a preferred embodiment of the invention the movement speed of a gesture to be performed in an area detecting a touch is determined, and a floor marking to be presented on the display is brought to move at a speed that is proportional to the determined movement speed of the gesture to be performed in an area detecting a touch. Consequently, the aforementioned speed of the floor marking is preferably increased as the movement speed of the gesture to be performed in the area detecting a touch increases and correspondingly is decreased as the movement speed decreases.

In a preferred embodiment of the invention a gesture to be performed in an area detecting a touch for decelerating the speed of a floor marking that has been brought to move is detected, and the speed of the floor marking is decelerated on the basis of the gesture to be performed for decelerating the aforementioned floor marking.

In the method according to the invention for giving an elevator call, an input given by a user is received and also a floor marking to be presented on the display is moved on the basis of the input given by a user.

In a preferred embodiment of the invention the speed of a floor marking that has been brought to move is decelerated at a set deceleration.

In a preferred embodiment of the invention, which embodiment comprises a touch-sensitive display, a call according to a floor marking is registered when detecting a touch meeting the call-giving criterion on the display at the point of the aforementioned floor marking. In a preferred embodiment of the invention the floor marking connected to the aforementioned registered call is presented on the display.

In a preferred embodiment of the invention a number of consecutively situated floor markings are presented on the display simultaneously.

In a preferred embodiment of the invention a gesture to be performed in the direction of a string formed by floor markings consecutively situated on the display as well as the movement direction of the gesture to be performed in the direction of the string are detected, and the floor markings consecutively situated on the display are moved in the detected movement direction of the direction of the string.

In a preferred embodiment of the invention consecutively situated floor markings intended to be presented on the display and also the consecutive sequence of the floor markings are recorded in the memory of the call-giving device.

In a preferred embodiment of the invention only a part at a time of the aforementioned consecutively situated floor markings to be recorded in the memory are presented on the display.

In a preferred embodiment of the invention a string formed by consecutively situated floor markings is conveyed on the display in the direction of the string, starting from an edge area of the display and ending in an edge area of the display.

In a preferred embodiment of the invention a floor marking is removed from the display when it arrives in an edge area of the display.

In a preferred embodiment of the invention a second floor marking is added, in place of the floor marking to be removed from the display, to the opposite end of the string formed by the floor markings.

In a preferred embodiment of the invention the size of the floor markings traveling in a string changes when the position of a floor marking on the display changes. In some embodiments the width of a floor marking traveling in the horizontal direction across the display from one edge area to another first increases as the floor marking diverges from the edge area and starts to decrease again as the floor marking approaches the edge area of the opposite end. In some embodiments the height of a floor marking traveling in the vertical direction across the display from one edge area to another increases as the floor marking diverges from the edge area and starts to decrease again as the floor marking approaches the edge area of the opposite end. In some embodiments the brightness of a floor marking traveling across the display from one edge area to another increases as the floor marking diverges from the edge area and starts to dim again as the floor marking approaches the edge area of the opposite end. In this way, by means of a string of consecutive floor markings a visual impression is formed of a rotating roll, or of a part of a roll, in which the changing size and/or the change in brightness of a floor marking consequently enhances the information about/noticeability of the movement of the floor markings.

In some embodiments of the invention the size of the floor markings remains constant when the position of a floor marking on the display changes. In some embodiments the brightness of a floor marking remains constant when the position of a floor marking on the display changes.

A string formed by consecutive floor markings traveling on the display can be linear, and it can travel across the display in the horizontal direction, in the vertical direction or diagonally. On the other hand, a string formed by consecutive floor markings can form a curve, such as a U-curve, which starts from an edge area of the display and ends in an edge area of the display. Of course, a string of consecutive floor markings can also be formed in numerous other ways, such as in the shape of an S-curve or of a V-curve, starting from an edge area of the display and ending in an edge area of the display. For moving the floor markings, a gesture must be performed in an area detecting a touch in the direction of the string formed by the floor markings, in other words, for moving a string of floor markings traveling in the horizontal direction a gesture must be performed in the horizontal direction in an area detecting a touch; correspondingly, for moving a string of floor markings traveling in the vertical direction a gesture must be performed in the vertical direction, for moving a string of floor markings traveling in a U-curve direction a gesture must be performed in the U-curve direction, and so on.

Also a number of strings formed by consecutive floor markings can be displayed side by side on the display. This can be an advantage e.g. in connection with high-rise buildings/large numbers of floors, in which case a multidigit floor number can be presented as a combination of floor markings belonging to parallel rows of floor markings.

According to the invention an area detecting a touch can be connected to the display to become a touch-sensitive display; on the other hand, an area detecting a touch and the display can also be disposed separately in the call-giving device.

The call-giving device can comprise one or more separate buttons, and an input given by a user for moving a floor marking/string formed by floor markings can in this case be given with the aforementioned one or more buttons of the call-giving device.

An area detecting a touch, e.g. in connection with a touch-sensitive display, can be implemented utilizing various technologies that are per se known in the art; consequently the implementation can be based e.g. on resistive or capacitive touch detection technology. A touch of the display can be detected also e.g. with electromagnetic radiation traveling in front of the display, such as with a network of infrared rays, et cetera, traveling in the direction of the display. The gesture/motion to be performed on the display can be detected also e.g. with a video camera directed at the surface of the display. Also various technologies that are per se known in the art can be used in the implementation of the display according to the invention; consequently, the display according to the invention can be e.g. an LCD display, an OLED display, a LED display, a plasma display, or e.g. a bistable display, in which the state of the display remains unchanged also when the control signal of the display is missing: e.g. many so-called electronic paper displays are based on this type of technology.

In some embodiments the call-giving device also comprises a loudspeaker, with which a sound signal is formed when registering a new call or some other procedure performed by a user. In this way the usability of the call-giving device can be improved.

The call-giving device can be connected to a unit controlling the calls of an elevator system, via a communications channel between the call-giving device and the unit controlling the calls. The aforementioned communications channel can be a serial bus or a parallel bus implemented with one or more signal conductors; on the other hand, the call-giving device can also be connected to a unit controlling the calls of an elevator system via a wireless data transfer connection.

The call-giving device according to the invention is preferably intended for the giving of destination calls.

In some embodiments of the invention the floor marking comprises a name designator, which name designator comprises any of the following: the name of a tenant/resident, the logo of a business enterprise, the identification code of a business enterprise. In some embodiments of the invention the call-giving device is configured to present consecutively on the display a number of name designators, and the call-giving device is configured to move the aforementioned string of consecutive name designators on the basis of a gesture to be performed in the area detecting a touch. Consequently, e.g. a scrollable list of the residents of a building can be presented on the display, and a destination call can be formed by pressing the display at the point of a name of a resident for a sufficiently long period of time. In some embodiments the size of the name designator changes when the position of the name designator on the display changes; in some other embodiments the size of the name designator remains constant when the position of the name designator on the display changes.

In a preferred embodiment of the invention the call-giving device is fitted in connection with a floor level of the elevator system. In some embodiments the call-giving device is fitted into the elevator car. One advantage of the present invention is the small size of the device compared to a complete conventional call panel, particularly in high-rise buildings. Thus the device is also easier to dispose in the elevator system, and it can be disposed in the elevator car or on a floor level in connection with the door of an elevator or can even be integrated e.g. in the architrave of the door of an elevator on a floor level or in a wall part inside the elevator car. Furthermore, owing to its small size the device is easy to install in an existing elevator system also by retrofitting, e.g. in connection with repair work or with modernization of the elevator system.

The call-giving device according to the invention also increases ride comfort because a number of call-giving devices can be placed in the elevator lobby and queues for the call-giving device will shorten. In addition, a customer will no longer need to give a new call in the elevator car because one destination call given in the lobby is sufficient in the present invention. When determining the allocation of elevators in the case of a number of call devices, the location of each call-giving device can be taken into account and in large elevator systems the elevator that is mainly in use a lot can be favored.

The present invention allows many types of floor markings and does not limit the use only to numerical markings. Owing to its modifiability, the call-giving device is more fit for use than e.g. a call-giving panel provided with numerical buttons from zero to nine. When an elevator system changes, e.g. in the case of an addition of a new floor, upgrades are easy to effect simply by modifying the software and the call-giving device itself remains the same. The same type of call device can be disposed in all buildings and there is no need to make different versions for buildings of different heights. In addition, the call device is also suited for use by special groups, such as handicapped people.

Owing to their small size and cheap price, call-giving devices according to the invention can be fitted in a number of different places in a building, also e.g. in connection with an entrance to the building, along corridors, et cetera. Call-giving devices can also be connected to an elevator control system and/or to a building automation system to become a telecommunications network via which, in addition to elevator calls, also e.g. information relating to the positions of passengers in a building and advance information about the approach of elevator passengers can be conveyed from call-giving devices.

Also other information in addition to that which has been presented above can be presented on the display of a call-giving device. The display can have e.g. different areas, of which floor markings are presented in some and in some other information, such as position data of the elevator car. The display can also be configured to change from one display state to another, e.g. such that a call-giving view can be changed for a view presenting information about the position of an elevator car, and vice versa, e.g. by touching the display/an area detecting a touch.

The aforementioned summary, as well as the additional features and advantages of the invention presented below, will be better understood by the aid of the following description of some embodiments, said description not limiting the scope of application of the invention.

MORE DETAILED DESCRIPTION OF PREFERRED EMBODIMENTS OF THE INVENTION

Figure 1:
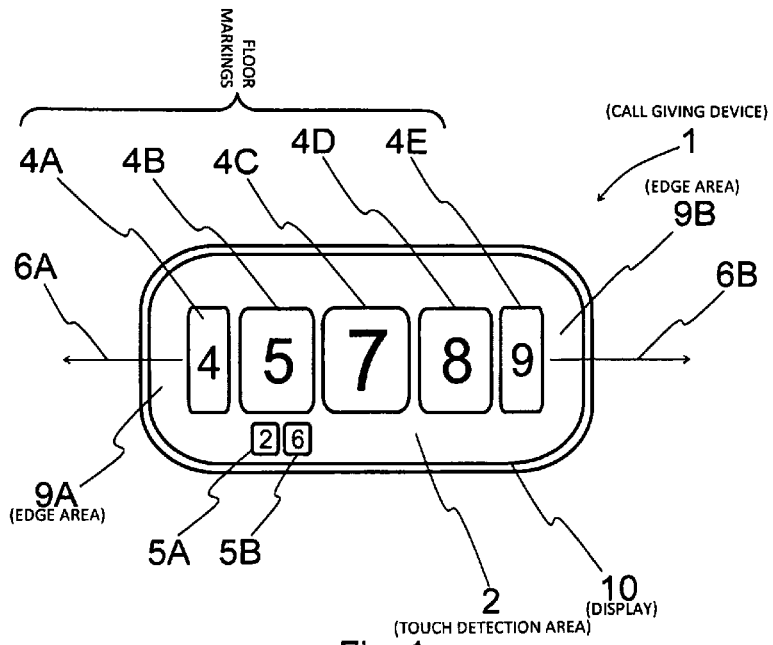
FIG. 1 presents a front view of the display of a call-giving device according to the invention

FIG. 1 presents a call-giving device 1 according to the invention for giving an elevator call, as viewed from the front, from the direction of usage. The call-giving device 1 comprises a touch-sensitive display. ITO (Indium Tin Oxide) patterning is used in the touch-sensitive sensoring, which patterning is etched onto the surface of a PET plastic film, onto one of its sides. This type of plastic film is translucent, and its thickness is e.g. approx. 100 micrometers. The plastic film is spread on top of the display 10, in which case an area 2 detecting a touch forms in front of the display 10. An OLED display functions as the display 10. In addition, as protection, outermost on top of the display 10 is a wear-resistant lens fabricated from e.g. plastic or glass. Inside the call-giving device 1 is a microcontroller, which is connected, in a manner the conducts electricity, to the area 2 detecting a touch. The microcontroller, which functions as a measuring unit, supplies burst-type measuring signals to the area detecting a touch, by means of which a change in capacitance in the area 2 detecting a touch is determined. The capacitance in the area 2 detecting a touch changes when an elevator passenger touches the surface/lens, in which case the microcontroller receives information about the input given by a user on the basis of the change in capacitance. This type of construction enables the fabrication of a very thin and structurally simple call-giving device. In addition, in the aforementioned solution the touch point of the display can also be detected from a change in capacitance.

Figure 3:
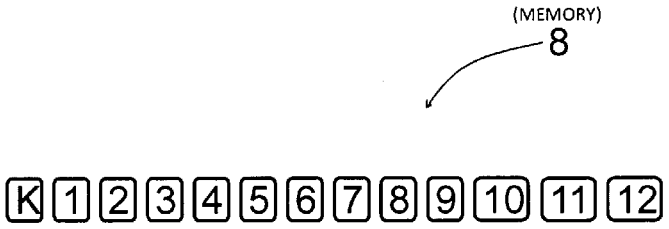
FIG. 3 presents the structure of the memory in a call-giving device according to the invention
Figure 4:
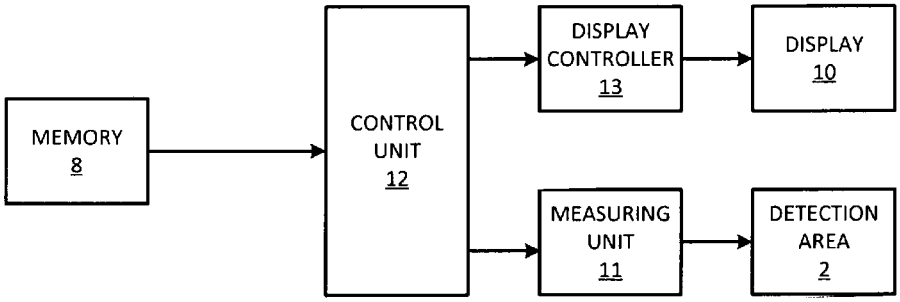
FIG. 4 presents a block diagram of the control of a call-giving device according to the invention

FIG. 4 presents a block diagram of a control of a touch-sensitive display according to FIG. 1. A control unit 12 comprising a microprocessor is connected with a communications channel to a measuring unit 11 and to a display controller 13. The control unit 12 is also connected with a data bus to a memory 8, in which a program to be executed in the microprocessor of the control unit 12 is stored. Among other things, the floor markings intended to be presented on the display 10 and also the sequence of floor markings that are consecutive to each other are recorded in the memory 8. The structure of the memory 8 is illustrated in FIG. 3. The control unit 12 sends to the display controller 13 control commands, on the basis of which the display controller 13 presents floor markings 4A, 4B, 4C, 4D, 4E on the display 10. In addition, the control unit 12 receives from the measuring unit 11 information about a touch occurring in the area 2 detecting a touch, as well as about the duration of the touch and also about the touch point e.g. in the form of coordinates.

The control unit 12 processes the touch data it receives from the measuring unit 11, combining the touch data with and comparing it to the information to be presented on the display 10. Based on the processing, the control unit 12 controls the display 10 and registers elevator calls.

Figure 2:
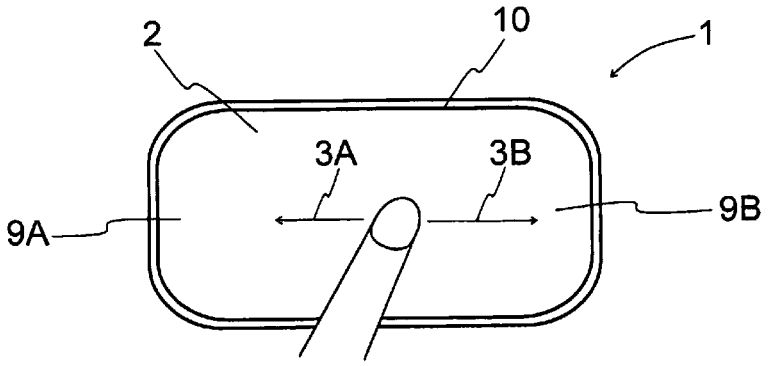
FIG. 2 presents the gesture to be performed in the area detecting a touch of the call-giving device according to FIG. 1

A string (FIG. 1) formed by consecutively situated floor markings 4A, 4B, 4C, 4D, 4E to be presented on the display 10 travels horizontally across the display 10 from one edge area 9A, 9B to the other. The sequence of the floor markings in a string formed by consecutive floor markings is sequentially from the floor marking indicating the lowest floor to the floor marking indicating the highest floor, and vice versa. Only a part of the floor markings recorded in the memory 8 of the control unit are presented on the display 10 at one time The control unit 12 determines a gesture to be performed in the area 2 detecting a touch on the display 10 when the measuring unit 11 detects a changing touch point as a finger moves on the display. The control unit determines both the movement direction and the movement speed of the gesture and controls the display 10 on the basis of the determined gesture/movement speed. FIG. 2 illustrates the gesture to be performed in the part of the touch-sensitive display according to FIG. 1 detecting a touch. The control unit 12 detects the gesture to be performed in the direction of the string formed by the floor markings 4A, 4B, 4C, 4D, 4E on the display 10 (the direction of the arrows 3A, 3B in FIG. 2), as well as the movement direction and also the speed at which the gesture is performed. On the basis of the detection the control unit 12 sends to the display controller 13 control commands for moving the floor markings to be presented on the display 10 in the detected movement direction (the possible movement directions of the floor markings are presented in FIG. 1 with the arrows 6A, 6B) and such that the movement speed of the floor markings 4A, 4B, 4C, 4D, 4E are set to be proportional to the movement speed of the gesture 3A, 3B performed in the area 2 detecting a touch. Consequently, when performing a gesture to the left, according to the arrow 3A, in the area 2 detecting a touch the string formed by the floor markings 4A, 4B, 4C, 4D, 4E moves to the left in the direction of the arrow 6A; correspondingly, when performing a gesture to the right, according to the arrow 3B, the string formed by the floor markings 4A, 4B, 4C, 4D, 4E moves to the right in the direction of the arrow 6B.

The control unit 12 removes from the display 10 a floor marking 4A, 4B, 4C, 4D, 4E when it arrives in the edge area 9A, 9B of the display and in the same connection adds another floor marking to the opposite end of the string formed by the floor markings 4A, 4B, 4C, 4D, 4E, in place of the floor marking 4A, 4B, 4C, 4D, 4E to be removed from the display, on the basis of the sequence among the floor markings recorded in the memory.

When the string formed by the floor markings 4A, 4B, 4C, 4D, 4E moves, the width of each floor marking to be presented on the display changes when the position on the display 10 of the floor marking 4A, 4B, 4C, 4D, 4E changes such that the width of a floor marking 4A, 4B, 4C, 4D, 4E traveling in the horizontal direction across the display from one edge area 9A, 9B to another first increases as the floor marking diverges from the edge area 9A, 9B and the width of the floor marking 4A, 4B, 4C, 4D, 4E starts to decrease again as the floor marking approaches the edge area 9A, 9B of the opposite end, such that a floor marking is at its widest when the distance to both edge areas 9A, 9B is of equal magnitude. In the same connection also the brightness of a floor marking 4A, 4B, 4C, 4D, 4E first increases as the floor marking diverges from the edge area 9A, 9B and the brightness of the floor marking 4A, 4B, 4C, 4D, 4E starts to dim again as the floor marking 4A, 4B, 4C, 4D, 4E approaches the edge area 9A, 9B of the opposite end. Controlled in this way, a moving string of floor markings 4A, 4B, 4C, 4D, 4E forms a visual impression of part of a rotating roll, in which the changing size and change in brightness of a floor marking 4A, 4B, 4C, 4D, 4E enhances the information about and noticeability of the movement of the floor markings 4A, 4B, 4C, 4D, 4E.

The control unit 12 of the call-giving device 1 registers a destination call to a floor according to a floor marking 4A, 4B, 4C, 4D, 4E when it detects a continuous touch of sufficiently long duration at the point of the aforementioned floor marking 4A, 4B, 4C, 4D, 4E on the display 10. When giving a destination call an elevator passenger presses the floor marking 4A, 4B, 4C, 4D, 4E that indicates that floor of the building to which the person giving the call is traveling by elevator.

The control unit 12 decelerates at a set deceleration a string of floor markings 4A, 4B, 4C, 4D, 4E that has been brought to move such that the string of floor markings 4A, 4B, 4C, 4D, 4E on the display 10 gradually stops and the view of the display 10 stabilizes. In addition to this, when the string of floor markings 4A, 4B, 4C, 4D, 4E moves, the control unit 12 determines a gesture, i.e. a touch, to be performed on the display in an area 2 detecting a touch for decelerating the speed of the string formed by the floor markings 4A, 4B, 4C, 4D, 4E. The speed of the string sharply decelerates when pressing the display as the floor markings move.

The control unit 12 also presents on the display registration data 5A, 5B connected to calls registered with the call-giving device 1 that are to be served. In the situation of FIG. 1 registration data 5A, 5B is presented on the display 10, according to which registration data the call-giving device 1 has destination calls registered to floors 2 and 6, which calls are still waiting to be served. The floor markings according to the destination calls waiting to be served are also removed from the string of floor markings 4A, 4B, 4C, 4D, 4E; for example, in the situation of FIG. 1 the floor marking of floor 6 has been removed from the string from between the floor markings of floors 5 and 7, because the destination call in question is awaiting service and no new corresponding call can be given yet.

Figure 5A:
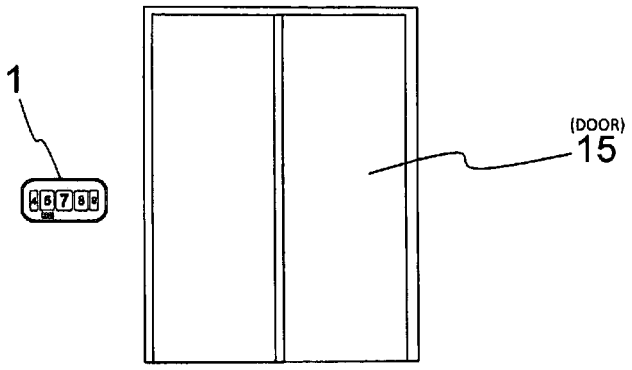
FIGS. 5*a*, 5*b* present some call-giving devices according to the invention fitted into an elevator system

FIG. 5*a* presents an elevator system into which a call-giving device 1 according to the embodiment of FIGS. 1-4 is fitted. In the solution presented in FIG. 5*a* the call-giving device 1 is disposed on a floor level in connection with the door 15 of the elevator. The call-giving device 1 in the elevator system of FIG. 5*b* differs from that presented above in connection with the embodiments of FIGS. 1-4 such that the string of floor markings 4A, 4B, 4C, 4D, 4E travels on the display 10 of the call-giving device in the vertical direction; likewise, for using the display the gesture to be performed in the area 2 detecting a touch occurs in the vertical direction. The height of floor markings traveling in the vertical direction across the display increases as a floor marking diverges from the edge area 9A, 9B of the display and starts to decrease again as the floor marking approaches the edge area 9A, 9B of the opposite end. According to FIG. 5*b*, the call-giving device 1 can be made to be elongated and narrow in its width, which has enabled integration of the call-giving device 1 into the architrave 16 of the door of an elevator. This type of placement method is advantageous both owing to the small space requirement and from the viewpoint of manufacturability.

Figure 5B:
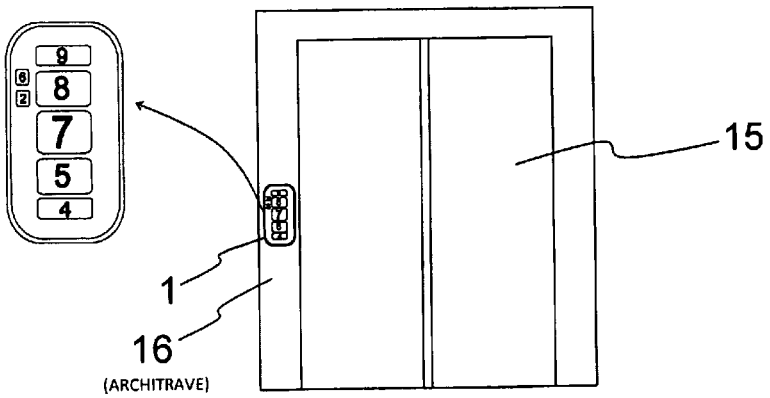

The call-giving device 1 in the elevator systems of FIGS. 5*a* and 5*b* is connected to the control unit (not in figure) of elevator calls in a manner that is per se known in the art via a communications channel, using some type of communication protocol that is known in the art, and the communication method in question between the call-giving device 1 and the control unit of elevator calls is not presented in more detail in this context.

The call-giving device 1 can also be disposed inside the elevator car as a replacement to a conventional control panel.

Figure 6:
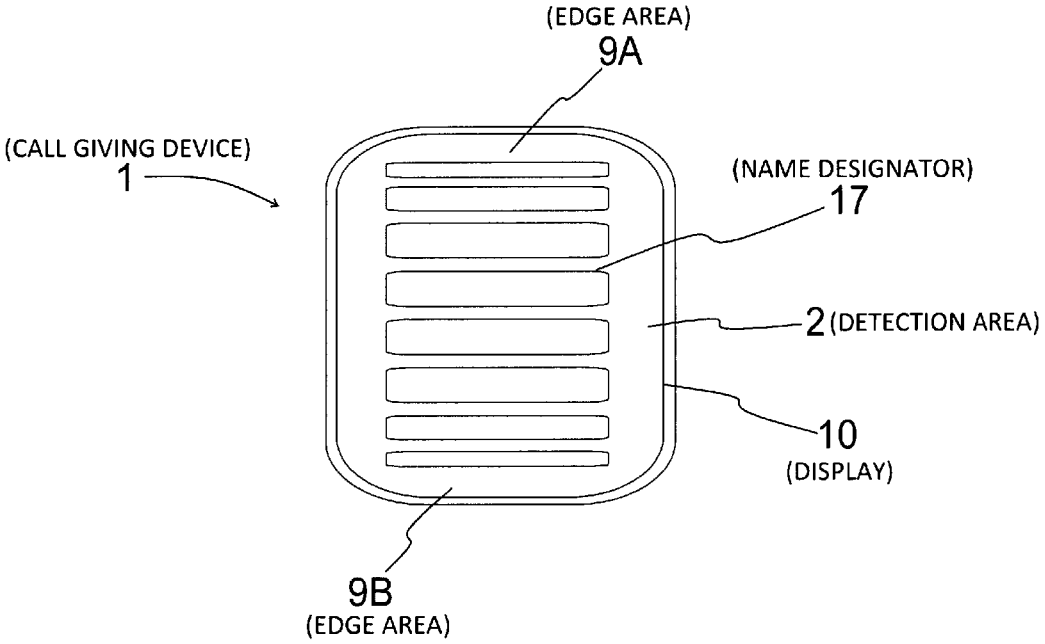
FIG. 6 presents a front view of a call-giving device according to the invention

The call-giving device 1 presented in FIG. 6 differs from that presented in connection with the embodiments of FIGS. 1-5 such that with the touch-sensitive display of the call-giving device 1 name designators 17 are presented in a vertical row. A name designator 17 comprises the information needed for giving a destination call, such as the name of a tenant/resident of the building, the logo of a company operating in the building, et cetera. Call giving occurs in the same manner as is presented above in connection with the embodiments of FIGS. 1-5, i.e. by pressing the display at the point of a name designator 17 for a sufficiently long period of time. For example, when pressing the display 10 at the point of the name of a resident of a building, the call-giving device registers a destination call to the floor on which the resident in question lives.

The display 10 is scrolled with a gesture to be performed in an area 2 detecting a touch in the same manner as is presented in connection with the embodiments of FIGS. 1-5. Consequently, the scrolling of the display occurs by performing a vertical gesture in an area 2 detecting a touch. Only a part of the possible name designators recorded in the memory of the control unit 12 are presented on the display 10 at one time. A name designator 17 is removed from the display when it arrives in an edge area 9A, 9B of the display; likewise a second name designator 17 is added to the other end of the row in place of the removed name designator 17, as is presented in connection with the embodiments of FIGS. 1-5. The height of the name designators changes such that the height of a name designator 17 increases when an added name designator 17 diverges from the edge area 9A, 9B of the display and starts to decrease again when the name designator 17 approaches the edge area 9A, 9B of the opposite end.

It is obvious to the person skilled in the art that the invention is not limited to the embodiments described above, but that many adaptations and different embodiments of the invention are possible within the framework of the inventive concept defined by the claims presented below.

The invention claimed is:

1. A call-giving device for giving an elevator call for an elevator, the call-giving device comprising:

a touch-sensitive display having at least one touch detection area; wherein the call-giving device is configured to detect a first gesture performed in the at least one touch detection area, the call-giving device is configured to register a call to a floor according to a floor marking, among a first string of consecutively situated floor markings, in response to detecting a touch meeting call-giving criterion on the touch-sensitive display at a point corresponding to the floor marking, the call-giving device is configured to present, on the touch-sensitive display, registration data associated with the registered call, the registration data indicative of registered floor calls that have not yet been served by the elevator, and the registration data presented as a second string of consecutively situated floor markings on the touch-sensitive display, and the call-giving device is configured to present the first and second strings of consecutively situated floor markings simultaneously on the touch-sensitive display.

2. The call-giving device according to claim 1, wherein the call-giving device is configured to move the floor marking on the touch-sensitive display based on the first gesture.

3. The call-giving device according to claim 1, wherein the call-giving device is further configured to, detect a movement direction of the first gesture, and move the floor marking on the touch-sensitive display in the detected movement direction.

4. The call-giving device according to claim 2, wherein the call-giving device is further configured to, determine a movement speed of the first gesture, and move the floor marking at a speed that is proportional to the determined movement speed of the first gesture.

5. The call-giving device according to claim 2, wherein the call-giving device is further configured to, detect a second gesture for decelerating a speed of the moving floor marking, and decelerate the speed of the moving floor marking based on the second gesture for decelerating the speed of the moving floor marking.

6. A call-giving device comprising:

an input device having at least one touch-sensitive display;

wherein the input device is configured to present first and second strings of consecutively situated floor markings simultaneously on the at least one touch-sensitive display;

wherein the input device is configured to register a call to a floor corresponding to a floor marking, among the first string of consecutively situated floor markings, in response to detecting a touch meeting call-giving criterion on the at least one touch-sensitive display at a point corresponding to the floor marking, wherein the second string of consecutively situated floor markings includes registration data indicative of registered floor calls that have not yet been served by the elevator;

wherein the input device is further configured to receive input from a user, and to move the floor marking presented on the at least one touch-sensitive display based on the input from the user.

7. The call-giving device according to claim 2, wherein the call-giving device is configured to decelerate, at a set deceleration, speed of the moving floor marking.

8. The call-giving device according to claim 1, wherein the first gesture is a gesture in a direction of the first string of consecutively situated floor markings; and the call-giving device is further configured to detect a movement direction of the first gesture in the direction of the first string of consecutively situated floor markings, and move the first string of consecutively situated floor markings in the detected movement direction.

9. The call-giving device according to claim 1, further comprising:

a memory in which the consecutively situated floor markings and a sequence of the consecutively situated floor markings are recorded; wherein the call-giving device is further configured to present, on the touch-sensitive display, only a portion of the consecutively situated floor markings recorded in the memory.

10. The call-giving device according to claim 9, wherein the first string of consecutively situated floor markings travels on the touch-sensitive display from a first edge area of the touch-sensitive display to a second edge area of the touch-sensitive display.

11. The call-giving device according to claim 10, wherein the call-giving device is further configured to remove a floor marking among the first string of consecutively situated floor markings from the touch-sensitive display when the floor marking arrives at the second edge area of the touch-sensitive display.

12. The call-giving device according to claim 11, wherein the call-giving device is further configured to add, in place of the floor marking removed from the display, a floor marking at an opposite end of the first string of consecutively situated floor markings.

13. The call-giving device according to claim 2, wherein the floor marking includes a name designator.

14. An elevator system, the elevator system comprises:

an elevator; and the call-giving device according to claim 1 for giving an elevator call for the elevator.

15. A method for giving an elevator call via an elevator call-giving device including a touch-sensitive display, the method comprising:

presenting a first string of consecutively situated floor markings on the touch-sensitive display;

registering a call to a floor corresponding to a floor marking, among the first string of consecutively situated floor markings, in response to detecting a touch meeting call-giving criterion on the touch-sensitive display at a point corresponding to the floor marking;

presenting, simultaneously with the first string of consecutively situated floor markings, a second string of consecutively situated floor markings on the touch-sensitive display, the second string of consecutively situated floor markings including registration data associated with the registered call, the registration data indicative of registered floor calls that have not yet been served by an elevator;

detecting a first gesture in a touch detection area of the touch-sensitive display; and controlling the floor marking based on the detected first gesture.

16. The method according to claim 15, wherein the controlling comprises:

moving the floor marking on the touch-sensitive display based on the first gesture in the touch detection area.

17. The method according to claim 16, wherein the controlling further comprises:

detecting a movement direction of the first gesture in the touch detection area; and moving the floor marking on the touch-sensitive display in the detected movement direction.

18. The method according to claim 16, wherein the controlling further comprises:

determining a movement speed of the first gesture in the touch detection area; and moving the floor marking on the touch-sensitive display at a speed that is proportional to the determined movement speed of the first gesture in the touch detection area.

19. The method according to claim 16, further comprising:

detecting a second gesture in the touch detection area for decelerating a speed of the moving floor marking; and decelerating the speed of the moving floor marking based on the second gesture for decelerating the moving floor marking.

20. A method for giving an elevator call via an elevator call-giving device including a touch-sensitive display having a touch detection area, the method comprising:

presenting a first string of consecutively situated floor markings on the touch-sensitive display;

registering a call to a floor corresponding to a floor marking, among the first string of consecutively situated floor markings, in response to detecting a first touch meeting call-giving criterion on the touch-detection area at a point corresponding to the floor marking;

presenting, simultaneously with the first string of consecutively situated floor markings, a second string of consecutively situated floor markings on the touch-sensitive display, the second string of consecutively situated floor markings including registration data associated with the registered call, the registration data indicative of registered floor calls that have not yet been served by an elevator;

receiving an input via the touch detection area; and moving the floor marking, among the first string of consecutively situated floor markings, on the touch-sensitive display based on the input from the user.

21. The method according to claim 16, wherein the controlling further comprises:

decelerating a speed of the moving floor marking at a set deceleration.

22. The method according to claim 15, wherein the first gesture is a gesture in a direction of the first string of consecutively situated floor markings; and the controlling includes, detecting a movement direction of the first gesture in the direction of the first string of consecutively situated floor markings, and moving the first string of consecutively situated floor markings in the detected movement direction.

23. The method according to claim 15, further comprising:

recording, in a memory of the call-giving device, the consecutively situated floor markings and a sequence of the consecutively situated floor markings; and presenting, on the touch-sensitive display, only a portion of the consecutively situated floor markings recorded in the memory.

24. The method according to claim 23, further comprising:

moving the first string of consecutively situated floor markings on the touch-sensitive display in a direction of the first string, from a first edge area of the touch-sensitive display to a second edge area of the touch-sensitive display.

25. The method according to claim 24, further comprising:

removing a floor marking among the first string of consecutively situated floor markings from the touch-sensitive display when the floor marking arrives at the second edge area of the touch sensitive display.

26. The method according to claim 25, further comprising:

adding, in place of the floor marking removed from the touch-sensitive display, another floor marking at an opposite end of the first string.

* * * * *